US007238043B2

(12) United States Patent
Reibke et al.

(10) Patent No.: US 7,238,043 B2
(45) Date of Patent: Jul. 3, 2007

(54) SPRING CLAMP ELECTRICAL TERMINAL

(75) Inventors: Heinz Reibke, Bad Salzuflen (DE); Juergen Feye-Hohmann, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 95 days.

(21) Appl. No.: 11/232,130

(22) Filed: Sep. 22, 2005

(65) Prior Publication Data

US 2006/0063420 A1 Mar. 23, 2006

(30) Foreign Application Priority Data

Sep. 23, 2004 (DE) ..... 10 2004 046 471

(51) Int. Cl.
*H01R 11/20* (2006.01)

(52) U.S. Cl. ..... 439/441

(58) Field of Classification Search ..... 439/441, 439/834, 438, 440, 828, 835
See application file for complete search history.

(56) References Cited

U.S. PATENT DOCUMENTS

| | | | | |
|---|---|---|---|---|
| 4,768,981 | A | 9/1988 | Hohorst | |
| 5,975,940 | A | 11/1999 | Hartmann et al. | |
| 6,786,779 | B2 * | 9/2004 | Feldmeier et al. | 439/729 |
| 6,814,608 | B2 | 11/2004 | Kollmann | |
| 6,893,286 | B2 * | 5/2005 | Drewes et al. | 439/441 |

FOREIGN PATENT DOCUMENTS

| | | | |
|---|---|---|---|
| DE | 197 11 051 | A1 | 9/1998 |
| DE | 198 02 945 | A1 | 7/1999 |
| DE | 199 03 965 | A1 | 7/2000 |
| DE | 101 03 107 | A1 | 7/2002 |
| DE | 202 10 105 | U1 | 11/2002 |
| DE | 20312861 | U1 * | 10/2003 |
| DE | 203 12 861 | U1 | 12/2003 |

* cited by examiner

*Primary Examiner*—Tho D. Ta
*Assistant Examiner*—Vanessa Girardi
(74) *Attorney, Agent, or Firm*—David S. Safran

(57) ABSTRACT

An electrical supply or connecting terminal with a clamping spring and a metal part located in an insulating housing having a conductor inlet opening for an electrical conductor. The clamping spring has a clamping leg and a contact leg, and the clamping leg and the metal part form a spring force clamp connection for the electrical conductor. The contact leg of the clamping spring is arranged essentially perpendicular to the insertion direction of the electrical conductor and a recess is formed in the contact leg for insertion of the electrical conductor. The clamping leg and the contact leg of the clamping spring are bent toward one another with the end of the clamping leg extending through the recess. The metal part has at least one mounting section inserted through the recess of the clamping spring in a direction opposite the insertion direction of the electrical conductor.

11 Claims, 3 Drawing Sheets

SPRING CLAMP ELECTRICAL TERMINAL

BACKGROUND OF THE INVENTION

1. Field of Invention

The invention relates to an electrical supply or connecting terminal with a clamping spring and with a metal part, the clamping spring and the metal part being located in an insulating housing which has an inlet conductor opening for entry of an electrical conductor which is to be connected, the clamping spring having a clamping leg and a contact leg, and the clamping leg and the metal part forming a spring force clamp connection for the electrical conductor to be connected.

2. Description of Related Art

Electrical terminal means or connecting means are used to establish an electrical terminal or electrical connection, specifically to produce an electrically conductive connection, a metallic connection, between a contact element and a mating contact element. Whether in the individual case there is a terminal means or a connecting means, is functionally relatively unimportant. It is often considered a terminal means when something locally movable is connected to something locally stationary, while often it is considered a connecting means when something locally movable is connected to something locally movable or even when something locally stationary is connected to something locally stationary.

The initially described supply terminal is known, for example, from German Patent Application DE 101 03 107 A1. In the known supply terminal, the metal part is made as a repeatedly bent contact element that has a first profile section which runs essentially perpendicular to the insertion direction of the conductor which is to be connected, with a plug opening for the conductor which is to be connected, and a second profile section which is bent away from it in the insertion direction. The clamping spring, is essentially U-shaped and projects with its clamping leg through the plug opening in the contact element so that the end of the clamping leg presses an electrical conductor which has been inserted into the plug opening against the second profile section of the contact element. The contact element and the clamping spring thus form a spring force clamp connection for an electrical conductor which is to be connected.

The clamping spring is connected to the contact element by the end of the second leg of the clamping spring being riveted securely to the contact element above the plug opening. In the known supply terminal, the fixing of the clamping spring to the contact element by means of riveting is comparatively involved. Moreover, the size of the known supply terminal is relatively large, in particular, the supply terminal is relatively tall since, by fixing the second leg of the clamping spring above the plug opening, the rear spring arc of the clamping spring is also located essentially above the approximately L-shaped contact element.

German Patent Application DE 196 54 611 A1 and corresponding to U.S. Pat. No. 5,975,940 disclose an electrical connecting terminal which also has an essentially U-shaped, open clamping spring and a conductor rail piece which is made as an angle bracket. The conductor rail piece has a retaining leg which is located perpendicular to the conductor entry direction, and a contact leg. In the retaining leg, a rectangular opening is formed through which the electrical conductor which is to be connected can be inserted. The U-shaped clamping spring, with the ends of its legs, is inserted and held in the opening such that the rear spring arc of the clamping spring in the conductor entry direction is located in front of the opening and the clamping leg of the clamping spring presses the inserted electrical conductor against the contact leg, so that, in this known plug-in connector, the clamping spring and the conductor rail piece also form a spring force clamp connection.

European Patent Application EP 1 391 965 A1 and corresponding U.S. Pat. No. 6,814,608 disclose a spring force clamp connection for an electrical conductor having a U-shaped clamping spring and a conductor rail piece. The conductor rail piece is made of a flat material and has a conductor insertion opening in the form of a rectangular material passage which has a perforated collar which extends in the conductor insertion direction and which together with the end of the clamping leg of the clamping spring forms the clamping site for the electrical conductor. In this conductor rail piece which is made as a flat current bar the clamping spring is inserted with the ends of its legs into the conductor insertion opening. When the clamping spring is opened, there is the danger that the clamping spring will slip or with the ends of its spring leg will even slip out of the opening so that proper positioning of the clamping spring, and thus, reliable contact-making of the electrical conductor, are no longer guaranteed under certain circumstances when an electrical conductor is being inserted.

Similar electrical supply terminals with an essentially U-shaped clamping spring and a metal part are known from German Utility Models DE 203 12 861 U1 and DE 202 10 105 U1. It is common to all these known supply terminals that the clamping spring is inserted in an opening of the metal part so that, when the clamping spring is opened, there is the danger that the clamping spring will slip.

In addition, loop-shaped clamping springs are also known in electrical supply or connecting terminals from the prior art, for example, from German Patent Application DE 197 11 051 A1 or German Patent DE 198 02 945 C2, specifically, as so-called tension springs in tension spring terminals. Tension spring terminals have become established on the market over time, in addition to screw terminals and recently also in addition to electrical terminals with insulation piercing terminal technology, and have been used millions of times especially as modular terminals. The advantage of tension spring terminals as compared to screw terminals consists in that the tension spring terminals enable faster and easier wiring. To actuate a tension spring terminal, only one actuating tool is necessary, for example, a screwdriver, which is pressed into the actuating shaft to open the terminal. In doing so, the tip of the screwdriver tensions the tension spring, by which the clamping site is opened. A conductor which is to be connected can then be inserted through the recess into the clamping leg, and it is clamped by the lower edge of the recess again a conductor rail which is connected to the tension spring after pulling out the screwdriver.

One special embodiment of a tension spring terminal is known from German Patent DE 35 14 099 C2 and corresponding U.S. Pat. No. 4,768,981. This tension spring terminal, besides a loop-shaped tension spring, has a specially made conductor rail with two lateral edges so that the conductor rail runs spaced apart from the contact leg of the tension spring. In this tension spring terminal, besides a connection of a flexible conductor in a recess in the clamping leg, in addition, a solid conductor can be pushed between the contact leg and the conductor rail. Since only a relatively small clamping force is applied to the solid conductor which is inserted into the terminal parallel to the contact leg and to the conductor rail, the electrical connection is very heavily dependent on the production tolerances and the diameter of the solid conductor.

One development of the tension spring terminal described directly above is disclosed by German Patent Application DE 199 03 965 A1. In this tension spring terminal, two electrical conductors can be inserted from the same side through the opening in the clamping leg, one conductor then being located underneath and one conductor being located above the conductor rail. The conductor which is located above the conductor rail is pressed against the conductor rail by the specially made contact leg of the tension spring.

SUMMARY OF THE INVENTION

A primary object of this invention is to provide an electrical supply or connecting terminal of the initially described type which enables simple, but secure fixing of the clamping spring at a size as small as possible even with larger cross sections of the conductor to be connected.

This object is achieved according to a first embodiment of the invention by an electrical supply or connecting terminal of the initially described type being having the contact leg of the clamping spring arranged essentially perpendicular to the insertion direction of the electrical conductor to be connected and the contact leg of the clamping spring having a recess for insertion of the electrical conductor to be connected. The clamping leg and the contact leg of the clamping spring are bent toward one another such that the end of the clamping leg extends through the recess in the contact leg, and that the metal part has two opposing legs and a bridge which connects the legs, the legs running essentially parallel to the insertion direction of the electrical conductor to be connected, and the ends of the legs each being made as mounting sections which can be inserted in a direction opposite the insertion direction of the electrical conductor to be connected through a recess in the contact leg, so that the clamping spring, with its recess in the contact leg, can be slipped onto the mounting sections, and thus, can be attached to the metal part.

The electrical supply or connecting terminal in accordance with the invention thus differs, first of all, from the supply terminals known in the prior art in that the terminal spring is not made U-shaped, but rather is loop-shaped. Moreover, in the electrical supply or connecting terminal of the invention, a recess for insertion of the electrical conductor to be connected is made in the contact leg of the clamping spring. The contact leg of the clamping spring is not arranged parallel, but essentially perpendicular to the insertion direction of the electrical conductor to be connected.

Moreover, in the supply or connecting terminal in accordance with the invention, the fixing of the clamping spring and metal part does not take place by the clamping spring, with the ends of its legs being inserted into an opening in a leg of the metal part or in the conductor rail, but by the clamping spring with its recess being slipped onto the metal part. To attach the clamping spring relative to the metal part, two mounting sections are formed on the metal part which are inserted through the recess in a direction opposite the insertion direction of the electrical conductor to be connected. To mount the clamping spring on the metal part, the contact leg with its recess is thus placed over the two mounting sections of the metal part so that the recess encompasses the two mounting sections in the manner of a frame. As in the prior art, the end of the clamping leg and the metal part form a clamping site for the electrical conductor in which the end of the clamping leg presses the electrical conductor which is to be connected against the metal part.

However, the known tension spring terminals also differ distinctly both in configuration and also in their function from the supply or connecting terminal of the invention. In the known loop-shaped tension springs, corresponding to their name, the conductor which is to be connected is drawn against the conductor rail by the clamping leg. In contrast, in the supply or connecting terminal of the invention, the conductor which is to be connected is pressed by the clamping leg against an area of the metal part. Moreover, in tension springs there is a recess in the clamping leg, while in the clamping spring of the supply or connecting terminal in accordance with the invention, the recess is made in the contact leg.

According to a second embodiment of the electrical supply or connecting terminal of the invention, in which the clamping spring is made as described above, the object is achieved in that the metal part is made as a flat current bar in which a recess is formed for inserting the electrical conductor to be connected.

The metal part is thus similar, first of all, to the conductor rail piece known from European Patent Application EP 1 391 965 A1 and corresponding U.S. Pat. No. 6,814,608. However, in contrast to this known conductor rail piece, in the current bar there is no material passage with a perforated collar inside wall which extends in the insertion direction of the electrical conductor to be connected, but the mounting section is punched out of the current bar and bent down opposite the insertion direction of the electrical conductor to be connected. The clamping spring is seated with its contact leg on the current bar such that the recess in the contact leg and the recess in the current bar are aligned with one another, and the mounting section of the current bar projects through the recess in the contact leg in a direction opposite the insertion direction of the electrical conductor to be connected. In this way, fixing of the clamping spring on the current bar is possible.

Preferably, to better fix the clamping spring on the current bar, on the end of the recess opposite the mounting section, a second mounting section is punched out of the current bar and is likewise bent down opposite the insertion direction of the electrical conductor to be connected. To mount the clamping spring on the current bar, the contact leg with its recess is thus placed over the two mounting sections of the current bar and seated on the current bar. The distance between the two mounting sections is thus chosen corresponding to the length of the recess in the contact leg so that the clamping spring is fixed on the current bar by the two mounting sections which have been inserted through the recess in the contact leg.

While in the version described just above, in which the metal part is made as a flat current bar, the metal part extends essentially perpendicular to the insertion direction of the electrical conductor to be connected, the direction of primary extension of the first version of the metal part runs essentially parallel to the insertion direction of the conductor to be connected.

According to a preferred configuration of the electrical supply or connecting terminal of the invention, on the end of the recess away from the end of the clamping leg, a retaining section is punched out of the contact leg of the clamping spring and is bent down in the insertion direction of the electrical conductor to be connected. The retaining section which is bent down essentially perpendicular to the contact leg is used to better fix the clamping spring on the metal part. Depending on the execution of the metal part, the retaining section extends either through the recess in the current bar or the retaining section extends behind the mounting section of the metal part. The execution of the retaining section especially prevents twisting of the clamping spring when the electrical conductor is inserted.

According to another advantageous embodiment of the invention, the mounting section of the metal part is bent down such that the mounting section, together with the end of the clamping leg of the clamping spring, form an inlet funnel for the electrical conductor to be connected. The execution of the inlet funnel thus automatically correctly positions the tip of an electrical conductor which has been pushed through the conductor inlet opening into the insulating housing so that simple and exact connection of the electrical conductor to the electrical supply or connecting terminal is possible.

According to another advantageous embodiment of the invention which will be briefly mentioned here, the insulating housing has an actuating opening for insertion of an actuating tool, and on the clamping leg of the clamping spring, a kink is made which is aligned in the direction of the spring force of the clamping leg, so that the tip of the actuating tool can act on the kink for opening the clamping spring. Providing an actuating opening for insertion of an actuating tool, first of all, results in that the electrical supply or connecting terminal can also be used for fine wire flexible conductors in which opening of the clamping spring simply by inserting the electrical conductor is not possible. Moreover, by opening the clamping spring using the actuating tool, an already clamped electrical conductor can be released again from the clamping site.

The kink made on the clamping leg enables simpler action of the tip of the actuating tool on the clamping leg for opening the clamping spring. Moreover, in this way, the insertion depth of the actuating tool which is necessary for complete opening of the clamping spring into the actuating opening can be reduced.

In particular, there are many possibilities for embodying and developing the electrical supply or connecting terminal of the invention. In this respect, reference is made to the following description in conjunction with the accompanying drawings.

DETAILED DESCRIPTION OF THE INVENTION

Figure 1:
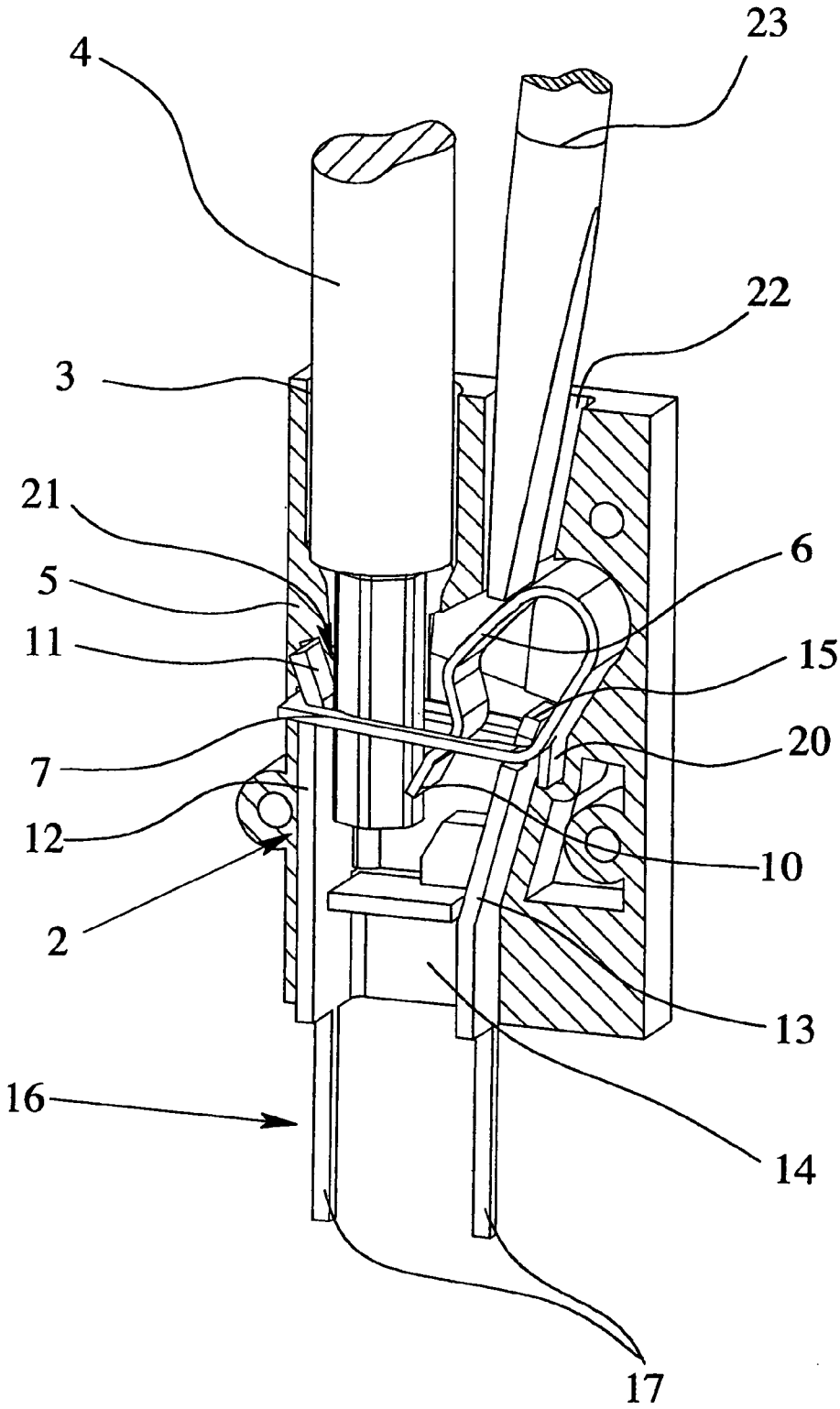
FIG. 1 shows an electrical supply or connecting terminal in accordance with the invention with an electrical conductor to be connected.
Figure 2:
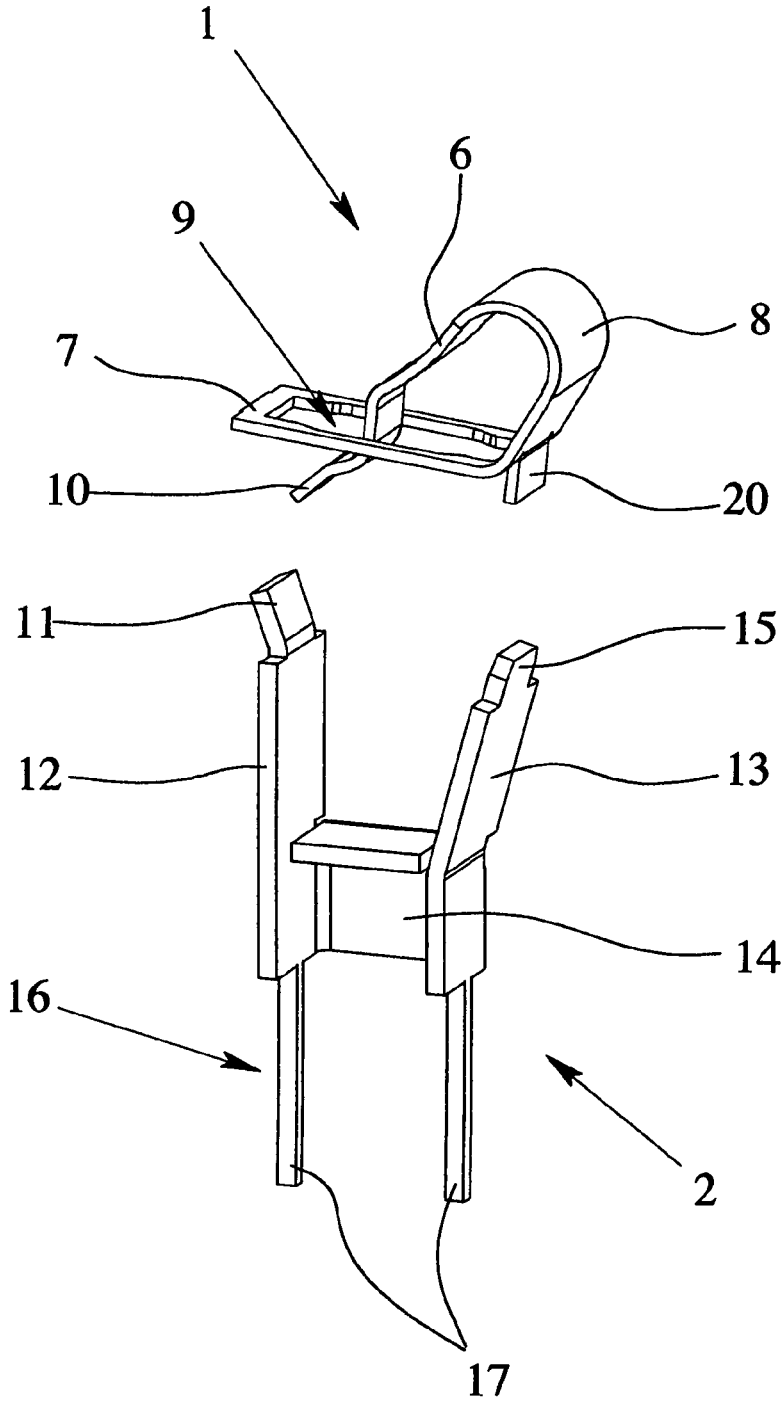
FIG. 2 is an exploded view of the clamping spring and the metal part of the electrical supply or connecting terminal as shown in FIG. 1 in the unmounted state.
Figure 3:
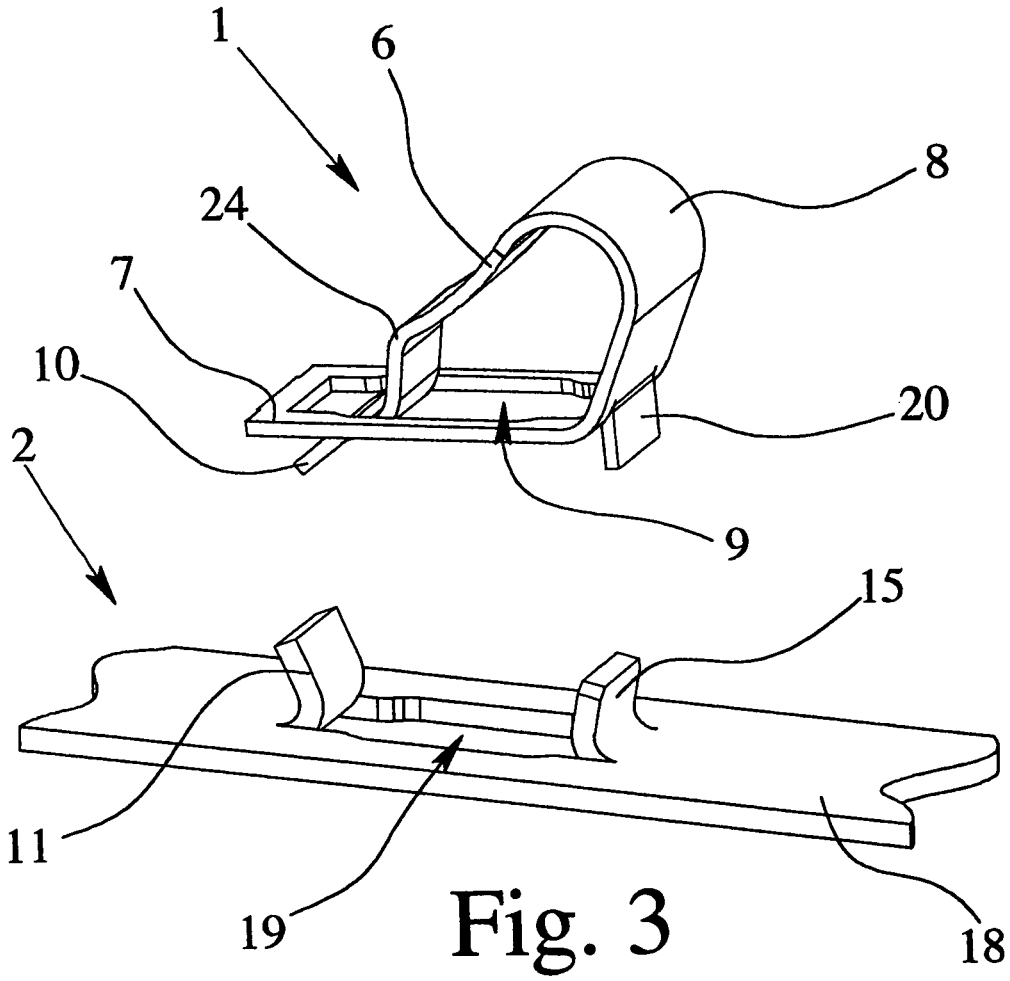
FIG. 3 is an exploded view of the clamping spring and a second configuration of a metal part of an electrical supply or connecting terminal in accordance with the invention, in the unmounted state.

FIGS. 1 to 3 show a clamping spring 1 and a metal part 2 of a supply or connecting terminal which is shown altogether only in FIG. 1. The supply or connecting terminal includes an insulating housing 5 which has a conductor entry opening 3 for inlet of an electrical conductor 4 to be connected and in which the clamping spring 1 and the metal part 2 are located. The clamping spring 1 has a clamping leg 6, a contact leg 7 and a back 8 which connects the clamping leg 6 and the contact leg 7.

As FIG. 1 shows, the contact leg 7 of the clamping spring 1 is arranged essentially perpendicular to the insertion direction of the electrical conductor 4 to be connected in the insulating housing 5. In the contact leg 7 of the clamping spring 1, a recess 9 is formed for insertion of the electrical conductor 4 to be connected. If the electrical conductor 4 is inserted through the recess 9, the tip of the electrical conductor 4 is pressed by the end 10 of the clamping leg 6 against the metal part 2, by which electrical contact between the conductor 4 and the metal part 2 is accomplished. Even if the electrical conductor 4 has not yet been inserted into the clamping spring 1 through the recess 9, the end 10 of the clamping leg 6 extends into the recess 9 in the clamping leg 7. The clamping spring 1 thus has a somewhat loop-shaped outline, the contact leg 7, and thus, also the recess 9, running essentially perpendicular to the insertion direction of the electrical conductor 4 to be connected.

To mount the clamping spring 1 on the metal part 2, the metal part 2 has at least one mounting section 11 which extends opposite the insertion direction of the electrical conductor 4 to be connected through the recess 9, so that the clamping spring 1 with its recess 9 can be slipped onto the metal part 2. The figures show two fundamentally different possible embodiments of the metal part 2.

In the embodiment of the electrical supply or connecting terminal of the invention which is shown in FIGS. 1 & 2, the metal part 2 has two opposing legs 12, 13 and a bridge 14 which connects the legs 12, 13. The legs 12, 13 run essentially parallel to the insertion direction of the electrical conductor 4 to be connected, the ends of the legs 12, 13 each being made as a mounting section 11, 15 so that the clamping spring 1 with its recess 9 surrounds the two mounting sections 11, 15 of the metal part 2 in the manner of a frame. If the distance between the ends of the two mounting sections 11, 15 is slightly greater than the length of the recess 9 in the contact leg 7, as a result of the elastic properties of the legs 12, 13, first the clamping spring 1 with the recess 9 can be forcibly slipped onto the mounting sections 11, 15, afterwards the clamping spring 1 however is securely held by the metal part 2 as a result of the elastic property of the legs 12, 13.

In the embodiment shown in FIGS. 1 & 2, the metal part 2 has a plug part 16 which encompasses two solder pins 17 so that the electrical supply terminal shown in FIG. 1 can be used as a print terminal for printed circuits.

Figure 4:
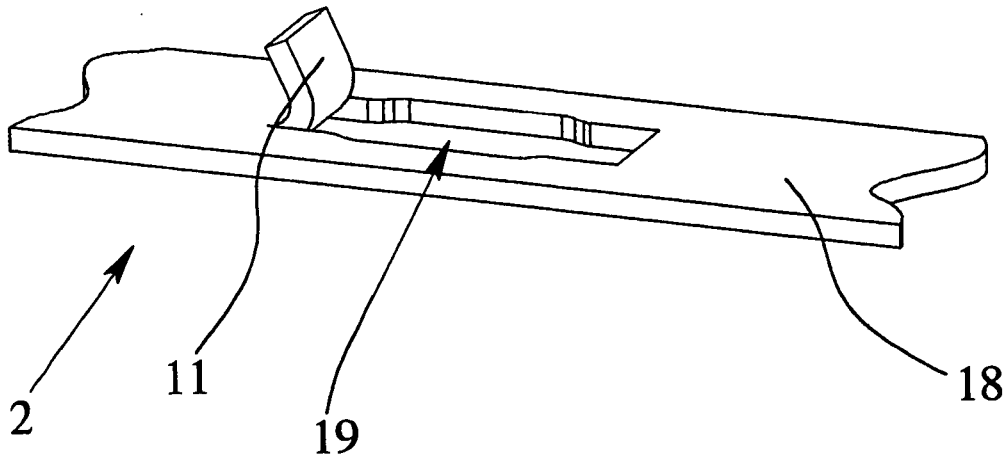
FIG. 4 shows a modified version of the metal part shown in FIG. 3.

Another configuration of the metal part 2 is shown in FIGS. 3 & 4. In these embodiments, the metal part 2 is made as a flat current bar 18 in which there is a recess 19 for insertion of the electrical conductor 4 to be connected. The mounting section 11 for fixing the clamping spring 1 on the metal part 2 is punched out of the current bar 18 and is bent down opposite the direction of insertion of the electrical conductor 4 to be connected. The mounting section 11 corresponds to the part of the material of the contact leg 7 which is punched out of the contact leg 7 when the recess 9 is formed. Thus, the recess 9 and the mounting section 11 can be produced especially easily in a material-saving manner by a punching and bending process.

When an electrical conductor 4 is inserted through the recess 9, the tip of the electrical conductor 4 is pressed through the end 10 of the clamping leg 6 against the inside surface of the mounting section 11, by which electrical contact is produced between the electrical conductor 4 and the current bar 18. By the corresponding choice of the length of the mounting section 11, thus the surface of the area of the current bar 18 against which the tip of the electrical conductor 4 is pressed by the clamping leg 6 can also be fixed.

In the current bar 18 shown in FIG. 3, in addition to the mounting section 11 on the opposite end of the recess 19, a second mounting section 15 is punched out of the current bar 18 and bent down. The execution of two mounting sections 11, 15 on the current bar 18 improves the fixing of the clamping spring 1 on the current bar 18. The two mounting sections 11, 15 are surrounded by the recess 9 in the contact leg 7 in the manner of a frame.

Especially when the current bar 18 has only one mounting section 11 (FIG. 4) is it advantageous if an additional retaining section 20 is formed from the contact leg 7 on the clamping spring 1. The retaining section 20 is punched out on the end of the recess 9 away from the end 10 of the clamping leg 6 and bent down in the insertion direction of the electrical conductor 4 to be connected. When the clamping spring is mounted on the current bar 18, the retaining section 20 fits into the recess 19 in the current bar 18. The clamping spring 1 is then attached to the current bar 18 in that the mounting section 1 of the current bar 18 fits into the recess 9 in the contact leg 7 and the retaining section 20 fits into the recess 19 in the current bar 18.

In an execution of the metal part 2 as shown in FIGS. 1 & 2, the retaining section 20 made on the clamping spring 1 is also used to improve the fixing of the clamping spring 1 on the metal part 2. The retaining section 20 from the outside adjoins the second mounting section 15 of the metal part 2 so that twisting of the clamping spring 1 when an electrical conductor 4 is being connected is prevented.

As is apparent in FIGS. 1 & 2, the mounting section 11 of the metal part 2 is bent down such that, together with the end 10 of the clamping leg 6, it forms an inlet funnel 21 for the electrical conductor 4 to be connected. In order to facilitate insertion of an electrical conductor 4 into the electrical supply or connecting terminal and in order, if necessary, to remove a connected electrical conductor again from the supply terminal or connecting terminal, the insulating housing 5 has an actuating opening 22 for insertion of an actuating tool 23, for example, the tip of a screwdriver. With the actuating tool 23, it is possible to press on the clamping leg 6 of the clamping spring 1, by which the clamping leg 6 opens so that an electrical conductor 4 can be inserted or removed more easily. On the clamping leg 6, a kink 24 is formed which is aligned in the direction of the spring force of the clamping leg 6. The tip of the actuating tool 23 can act on the kink 24, by which the maximum necessary insertion depth of the actuating tool 23 into the actuating opening 22 for complete opening of the clamping spring 1 is reduced.

It is altogether apparent from the figures that in the electrical supply or connecting terminal as claimed in the invention the fixing of the clamping spring 1 and the metal part 2 can be produced especially easily, at the same time also the clamping spring 1 and the metal part 2 themselves can be produced especially easily in a material-saving manner. The metal part 2 is preferably made of a material with good conductivity, for example, from a copper alloy. In contrast, the clamping spring 1 can be made, for example, from spring steel.

What is claimed is:

1. Electrical supply or connecting terminal, comprising a clamping spring and a metal part, the clamping spring and the metal part being located in an insulating housing which has a conductor inlet opening for entry of an electrical conductor which is to be connected, the clamping spring having a clamping leg and a contact leg, and the clamping leg and the metal part forming a spring force clamp connection for the electrical conductor to be connected, wherein the contact leg of the clamping spring is arranged essentially perpendicular to the insertion direction of the electrical conductor to be connected, and a recess is located in the contact leg for insertion of the electrical conductor to be connected, wherein the clamping leg and the contact leg of the clamping spring are bent toward one another with the end of the clamping leg extending through the recess, wherein the metal part has two opposing resilient legs and a bridge which connects the legs, the legs running essentially parallel to the insertion direction of the electrical conductor to be connected and the ends of the legs each being made as mounting sections, wherein the distance between the mounting sections in an unstressed state is slightly larger than the length of the recess in the contact leg; and the clamping spring with its recess is mounted on the mounting sections of the metal part, wherein the mounting sections extend through the recess in a direction opposite the insertion direction of the electrical conductor to be connected.

2. Electrical supply or connecting terminal as claimed in claim 1, wherein the metal part is connected to one of a socket or plug part.

3. Electrical supply or connecting terminal as claimed in one of claim 1, wherein on an end of the recess away from the end of the clamping leg, a retaining section has been punched out of the contact leg and bent down in the insertion direction of the electrical conductor to be connected.

4. Electrical supply or connecting terminal as claimed in claim 1, wherein the mounting section of the metal part is bent down such that the mounting section together with a free end of the clamping leg forms an inlet funnel for the electrical conductor to be connected.

5. Electrical supply or connecting terminal as claimed in claim 1, wherein the insulating housing has an actuating opening for insertion of an actuating tool, and wherein on the clamping leg a kink is aligned in the direction of the spring force of the clamping leg so that a tip of an actuating tool for opening the clamping spring inserted in the actuating opening will act on the kink.

6. Electrical supply or connecting terminal as claimed in claim 1, wherein the metal part is made of a copper alloy.

7. Electrical supply or connecting terminal as claimed in claim 1, wherein the insulating housing has an actuating opening for insertion of an actuating tool, and wherein on the clamping leg a kink is aligned in the direction of the spring force of the clamping leg so that a tip of an actuating tool for opening the clamping spring inserted in the actuating opening will act on the kink.

8. Electrical supply or connecting terminal, comprising a clamping spring and a metal part, the clamping spring and the metal part being located in an insulating housing which has a conductor inlet opening for entry of an electrical conductor which is to be connected, the clamping spring having a clamping leg and a contact leg, and the clamping leg and the metal part forming a spring force clamp connection for the electrical conductor to be connected, wherein the contact leg of the clamping spring is arranged essentially perpendicular to the insertion direction of the electrical conductor to be connected, and a recess is located in the contact leg for insertion of the electrical conductor to be connected, wherein the clamping leg and the contact leg of the clamping spring are bent toward one another with the end of the clamping leg extending through the recess, on an end of the recess, away from the end of the clamping leg, a retaining section has been punched out of the contact leg and bent down in the insertion direction of the electrical conductor to be connected; and wherein the clamping spring with its recess is mounted on the metal part, the metal part having at least one mounting section which extends through the recess in a direction opposite the insertion direction of the electrical conductor to be connected, wherein the metal part is a flat current bar, within the current bar a recess is located for inserting the electrical conductor to be connected, wherein the mounting section has been punched out of the current bar and bent down in a direction opposite the insertion direction of the electrical conductor to be connected, wherein the retaining section fits into the recess of the current bar.

9. Electrical supply or connecting terminal as claimed in claim 8, wherein on an end of the recess opposite the mounting section, a second mounting section has been punched out of the current bar and bent down opposite the insertion direction of the electrical conductor to be connected.

10. Electrical supply or connecting terminal as claimed in claim 8, wherein the mounting section of the metal part is bent down such that the mounting section together with a free end of the clamping leg forms an inlet funnel for the electrical conductor to be connected.

11. Electrical supply or connecting terminal as claimed in claim 8, wherein the metal part is made of a copper alloy.

* * * * *